US005806204A

United States Patent [19]

Hoffman et al.

[11] Patent Number: 5,806,204

[45] Date of Patent: Sep. 15, 1998

[54] MATERIAL DRYER USING VACUUM DRYING AND VAPOR CONDENSATION

[75] Inventors: Karl H. Hoffman, Tequesta; Michael Pastore; Walter Glowacki, both of Palm Beach Gardens, all of Fla.

[73] Assignee: MMATS, Inc., Riviera Beach, Fla.

[21] Appl. No.: 876,143

[22] Filed: Jun. 13, 1997

[51] Int. Cl.[6] ..... F26B 13/30

[52] U.S. Cl. ..... 34/92; 34/605

[58] Field of Search ..... 34/73, 77, 86, 34/92, 595, 599, 601, 605, 606

[56] References Cited

U.S. PATENT DOCUMENTS

| | | | |
|---|---|---|---|
| 3,030,712 | 4/1962 | Lambert | 34/605 X |
| 3,425,136 | 2/1969 | Lambert . | |
| 4,041,614 | 8/1977 | Robinet . | |
| 4,257,173 | 3/1981 | Smith . | |
| 4,305,211 | 12/1981 | Peterson . | |
| 4,603,489 | 8/1986 | Goldberg | 34/77 |
| 4,615,125 | 10/1986 | Wyborn . | |
| 5,131,169 | 7/1992 | Jaster . | |
| 5,357,771 | 10/1994 | Schaal | 34/92 X |
| 5,430,956 | 7/1995 | Lange . | |
| 5,459,945 | 10/1995 | Shulenberger . | |
| 5,672,370 | 9/1997 | Durance et al. | 426/241 |
| 5,724,750 | 3/1998 | Burress | 34/92 X |

*Primary Examiner*—Henry A. Bennett
*Assistant Examiner*—Steve Gravini
*Attorney, Agent, or Firm*—McHale & Slavin PA

[57] ABSTRACT

A material drying apparatus having a sealable chamber for receipt of wet material, such as clothing. In this embodiment clothing placed into the chamber is dried upon the evacuation of air from the chamber wherein moisture drawn from the clothes is condensed on a condensate coil placed in the chamber. Heating coils placed around the chamber elevate the temperature to enhance condensate operation providing an energy efficient material dryer requiring no make-up air. Condensed water is purged after the drying process although provisions provide for an interim purge should excess liquid be drawn from the material.

17 Claims, 4 Drawing Sheets

MATERIAL DRYER USING VACUUM DRYING AND VAPOR CONDENSATION

FIELD OF THE INVENTION

This invention relates to a material dryer, and in particular to a dryer incorporating a condenser within a vacuum sealed chamber for drawing moisture at moderate temperatures.

BACKGROUND OF THE INVENTION

There exists a large variety of materials that require a low moisture content for usage. The most common material that requires a low moisture content is clothing. In this manner, clothing can be reused indefinitely if properly washed and dried. For this reason, this application will illustrate its usage as a clothes dryer, however, it will be obvious to one of ordinary skill in the art that the instant invention can be used for drying any type of material. The scope of the invention is defined by the claims appended hereto.

A clothes dryer is a modern material dryer used in conjunction with a washing machine which allows a consumer to quickly launder clothing. The conventional clothes dryer employs a rotating chamber which receives damp clothing directly after the wash cycle. Air is drawn into the rotating chamber at atmospheric pressure past a heating element. The heated air is used for drawing moisture from the clothes and the moisture laden air is continually exhausted from the clothes dryer.

The conventional material dryer expends a large amount of energy as the air drawn into the dryer must be heated. The amount of air drawn into the chamber and amount of energy expended during the process is further dependant upon the condition of the air being drawn into the dryer and amount of clothes to be dried. This process is not efficient due to the amount of thermal energy required to heat the air for a drying cycle which may take upwards of an hour to complete. In addition, if a clothes dryer is placed inside a home, the process causes additional energy loss as the air is drawn from inside the home.

Should the air being drawn have been previously cooled, such as in an air-conditioned home, the cooled air must be heated for the dryer while new air drawn into the home must be cooled. If the home was heated, the conventional dryer again draws treated air requiring the home to replace the air. In this example the heater of the home must operate to replace the air expelled by the dryer.

Should a clothes dryer be placed outside the home, typical of many southern homes, operation of the clothes dryer is affected by the amount of moisture in the air. A high amount of moisture will require the clothes dryer to operate for a longer period of time in order to complete a drying cycle. In addition, most clothes dryers operate on a timing cycle making it impossible to predict an accurate time to discontinue the heating process due to the various conditions of air make-up. Depending upon the weight of the clothes and moisture content therein as well as the type of air being drawn into the clothes dryer, the drying cycle may take upwards of hour to complete.

It is generally known that the evaporation temperature of a liquid decreases as the pressure of the surrounding air decreases. Thus, water can be drawn from a material at lower temperatures in a near vacuum environment thereby expending less energy if a lower temperature can be utilized. As a result, a number of prior art devices are directed to the modification of clothes dryers which have been developed to incorporate a vacuum or vacuum like chamber. However, these devices lose efficiency in that they constantly pump air into a chamber for purposes of discharging a volume of air and water vapor out of the device by use of a vacuum pump. Such devices require additional power as the incoming air must be circulated and in most cases heated.

For instance, U.S. Pat. No. 3,425,136 discloses a clothes dryer having an interior drum heater and vertical air ducts wherein the device continuously draws air and water vapor from inside a chamber by use of a vacuum pump. Similarly, U.S. Pat. No. 4,041,614 discloses a device which passes air and water vapor through an exit duct to the exterior of a cabinet. U.S. Pat. No. 4,257,173 discloses a "no heat" clothes dryer which simply incorporates a vacuum source coupled to an exhaust port.

U.S. Pat. No. 4,305,211 discloses a clothes drying chamber whereby air and moisture particles from within the chamber are discharged by creation of a suction on the chamber. U.S. Pat. No. 4,615,125 discloses yet another vacuum chamber with a perforated rotatable drum and vacuum pump which draws air and water vapor from the vacuum chamber and contained drum.

U.S. Pat. No. 5,131,169 discloses a clothes dryer with a drum enclosed in a shell having a compressor to remove air and water vapor from the shell. A cyclic operation of pumping heated air into the shell and removing saturated air is employed. U.S. Pat. No. 5,430,956 discloses a clothes drying device employing a turbo engine for drawing air from a drying room and condensing the liquid thereby reducing the volume of air produced by the drying process. U.S. Pat. No. 5,459,945 discloses a vacuum assisted system for drying clothes which includes an evaporation chamber which is located inside a condensation chamber. In this manner the device extracts water from the evaporation chamber by use of a condensation chamber to condense extracted vapor on the outer surface of the evaporation chamber. While the condenser is used, air is continually circulating out of the vacuum chamber by use of the vacuum pump.

Thus what is lacking in the art is a material drying device that eliminates the constant draw of air into the device, lowers the drying temperature, eliminates a constant evacuation by a vacuum pump, and decreases the amount of time to perform a drying cycle thereby reducing energy and operating costs.

SUMMARY OF THE INVENTION

The present invention teaches an energy efficient material drying method and device. The material dryer of the present invention employs a sealed chamber that allows a near vacuum to be drawn on material, such as clothing, placed within the chamber. Water in the form of vapor is drawn from the material placed within the device by use of a condenser placed within the chamber. The condenser operates to condense the water vapor evaporated from the material. The chamber temperature is slightly elevated to provide heat of vaporization. The evaporation temperature of a liquid decreases as the pressure of the surrounding air decreases. Heating elements are placed around the outer surface of the chamber wherein clothes contacting the surface of the chamber provide for heat transfer. A conveyor belt or paddle assembly allows for movement of the material and a circulation fan operates to enhance operation of the condenser. Condensed water is stored within the chamber until a drying cycle is complete, and excess water can be purged during the cycle if necessary.

In operation, the interior environment of the material dryer is evacuated of air by use of a vacuum pump to a point which causes the evaporating temperature of water contained within the material to be lower than the temperature at atmospheric pressure. As a result, liquid evaporates into the chamber in the form of water vapor. The water vapor is circulated past the condenser coils wherein the water is condensed into liquid and held in a holding tank. The use of heating coils provides for the heat of vaporization thereby allowing for efficient water removal.

The inner surface of the chamber is smooth allowing ease of movement of material while allowing for maximum contact with the sides of the chamber. The outer surface of the chamber can be heated by use of coolant coils that operate from the compressor. In this manner excess heat generated by the operating system can be returned to the chamber. A conveyor on the inside of the dryer rotates around a central axis for purposes of moving the material thereby providing uniform drying. Alternatively a paddle may also be used and drive a circulation fan for air circulation.

Monitoring of the material dryer is performed by use of conductivity sensors to measure the moisture content of the material being dried. Temperature probes are used to measure various temperatures and pressure sensors to measure pressure inside the chamber. The parameters are preset and allow for operation of the heating/cooling compressor. Activation of the compressor will cause heat to be built up and be distributed through the hot coils surrounding the dryer bin or, alternatively, heating elements not associated with the compressor placed around the drying bin may be activated. In any event the increase of heat speeds up the evaporation of liquid from the material to be dried. The newly released water vapor will thereby condense on the condenser coils and be routed to a liquid collection tank. If the liquid collection tank is filled, the tank may be purged either before, during, or after the drying operation. Sensors can also be used to report the moisture content which is indicative of the amount of drying that has occurred allowing the consumer to remove material, such as clothing to be pressed, before complete drying if preferred.

It is noted that liquid in the collection tank is relatively cool due to its inner action with the cold condenser coil. As a result, a set of cooling coils may be routed from the vacuum pump and through the collection tank so as to provide cooling action for the vacuum pump without the system consuming more energy. The cooling action extends the life of the vacuum pump and increases the overall efficiency of the system.

An object of the present invention is to provide a material dryer based upon the drawing of a partial vacuum on a sealed chamber with a condensate coil placed within the chamber for use in drawing moisture from clothing placed within the chamber.

Another object of the present invention is to provide a material dryer that eliminates the need for an in-flow of air.

An advantage of the present invention is to provide a material dryer capable of speeding the drying process by approximately fifty percent while using approximately fifty percent less energy over conventional drying devices.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
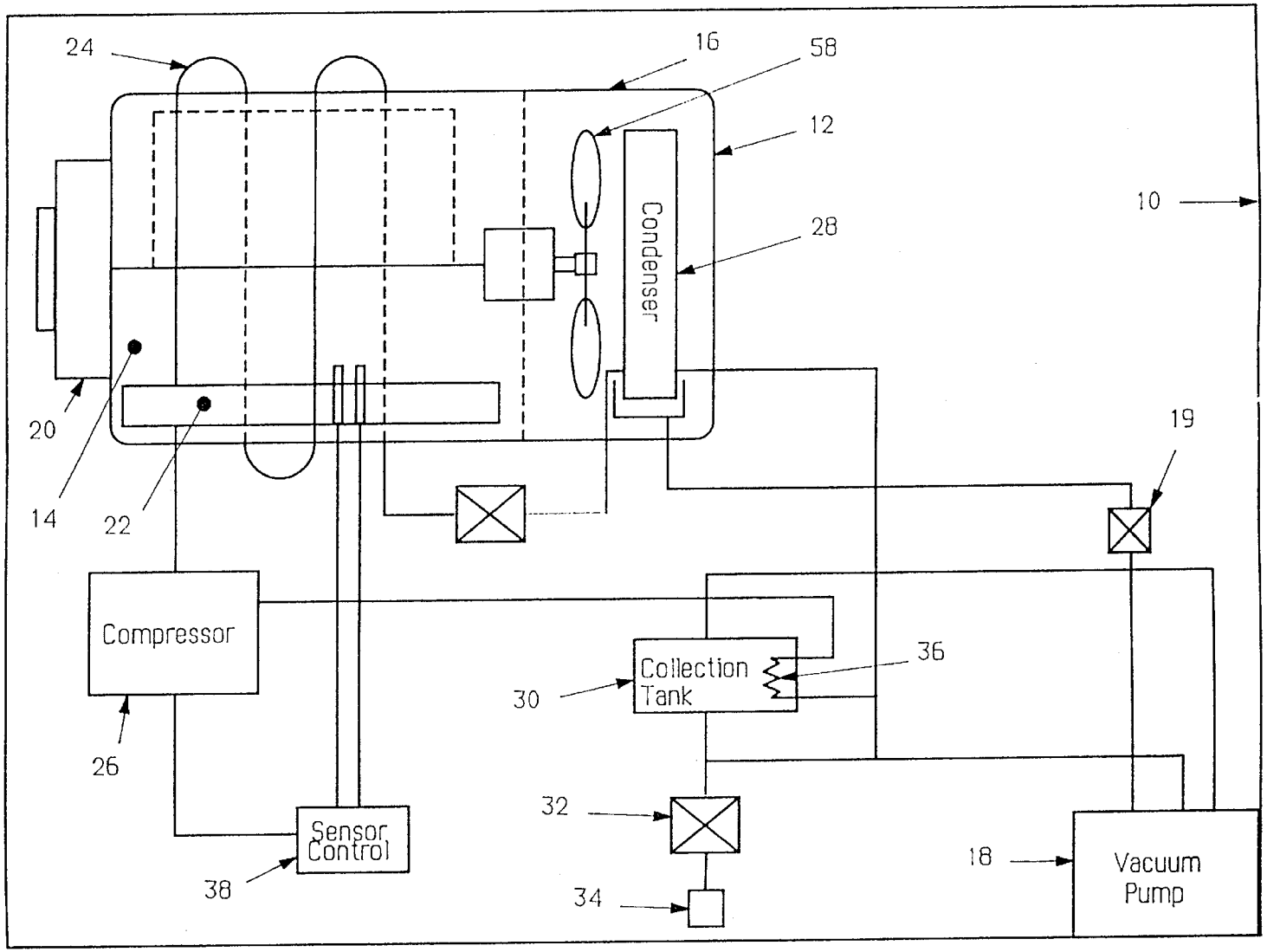
FIG. 1 is a flow schematic of the instant invention.

Referring to FIG. 1, set forth is a simplified flow schematic for the material dryer device of the instant invention. The material dryer includes a housing 10 having a cylindrically shaped chamber 12 mounted horizontally within the housing 10. The chamber 12 is hermetically sealed defining an interior 14 and an exterior 16. The interior 14 is fluidly coupled to a vacuum pump 18 capable of a drawdown vacuum of approximately 28 inches Hg. The vacuum pump 18 operates initially to withdraw air from the chamber through exhaust check valve 19 for maintaining a low pressure environment during the drying cycle with minimum pump operation. In the preferred embodiment, the air is drawn through an internal collection tank 31 through check valve 19 and delivered to a second collection tank 30 for holding and eventual discharge to drain. The second collection tank 30 may allow an overflow to drain, or include a solenoid 32 for purging the collected water to drain. The second collection tank 30 providing a ready source of fluid for creation of a water seal for operation of vacuum pump 18.

The interior 14 of the chamber 12 is accessible through a door 20 hingedly coupled to one end of the housing 10 and maintaining a pressure seal to the chamber 12 when closed. A paddle assembly 22, extending substantially along the longitudinal length of the chamber 12, is used to rotate the positioning of clothes placed within the chamber. The paddle assures the clothing contacts the inner surface of the chamber in such a way as to enhance heat transfer through the sidewall of the chamber which is heated along the exterior surface 16 of the chamber.

The chamber may be heated by an electric coil, utilize hot water preheater lines or the hot fluid line 24 as provided by a compressor system. The pressurized fluid is directed through an expansion valve before being directed through a condensate coil 28. The condensate coil 28 condenses moisture from clothing placed within the chamber with the condensed moisture collected in an internal collection tank 31. The condensate is held until the drying cycle is complete, or if full during the cycle, purged by vacuum pump 18 through check valve 19 to collection tank 30. A set of cooling coils 36 may be routed from the condenser 28 and through the collection tank so as to provide cooling action for the vacuum pump 18 without the system consuming more energy. The condensate in the collection tank is relatively cool due to its inner action with the cold condenser coil 28 and will also provide cooling action. The cooling action extends the life of the vacuum pump and increases the overall efficiency of the system.

Sensors 38 are available for determining the relative humidity within the chamber, pressure of drying chamber and temperature for operation of the compressor cycle and temperature control providing operation for only the time needed to complete a drying cycle.

In operation, wet clothing is placed into the chamber 12 through door 20 wherein the vacuum pump 18 draws down the environment within the chamber 12 in about one minute. The compressor 26 then becomes operational in a format similar to a conventional air conditioner with the condensate coils 28 placed within the chamber 12. The compressor pressurizes freon or the like refrigerant material to approximately 265 psi at a temperature of about 220° F. Instead of being used directly, the high pressure liquid from the compressor may be passed through a hot water preheating tank. The preheating tank water may then be used to heat the chamber exterior. The pressurized fluid is drawn through an expansion valve before placement through condensate coils 28. The condensate coils 28 draw the moisture out of the clothes wherein the condensate liquid drains into the collection tank 31. In this manner, 30 pounds of water can be evaporated in approximately 30 minutes, the system utilizing between 30,000 and 60,000 BTU's per hour. Sensors 38 may be used to monitor the time of operation or automatically determine the length of operation by determining moisture content, pressure and temperature of the chamber.

Figure 2:
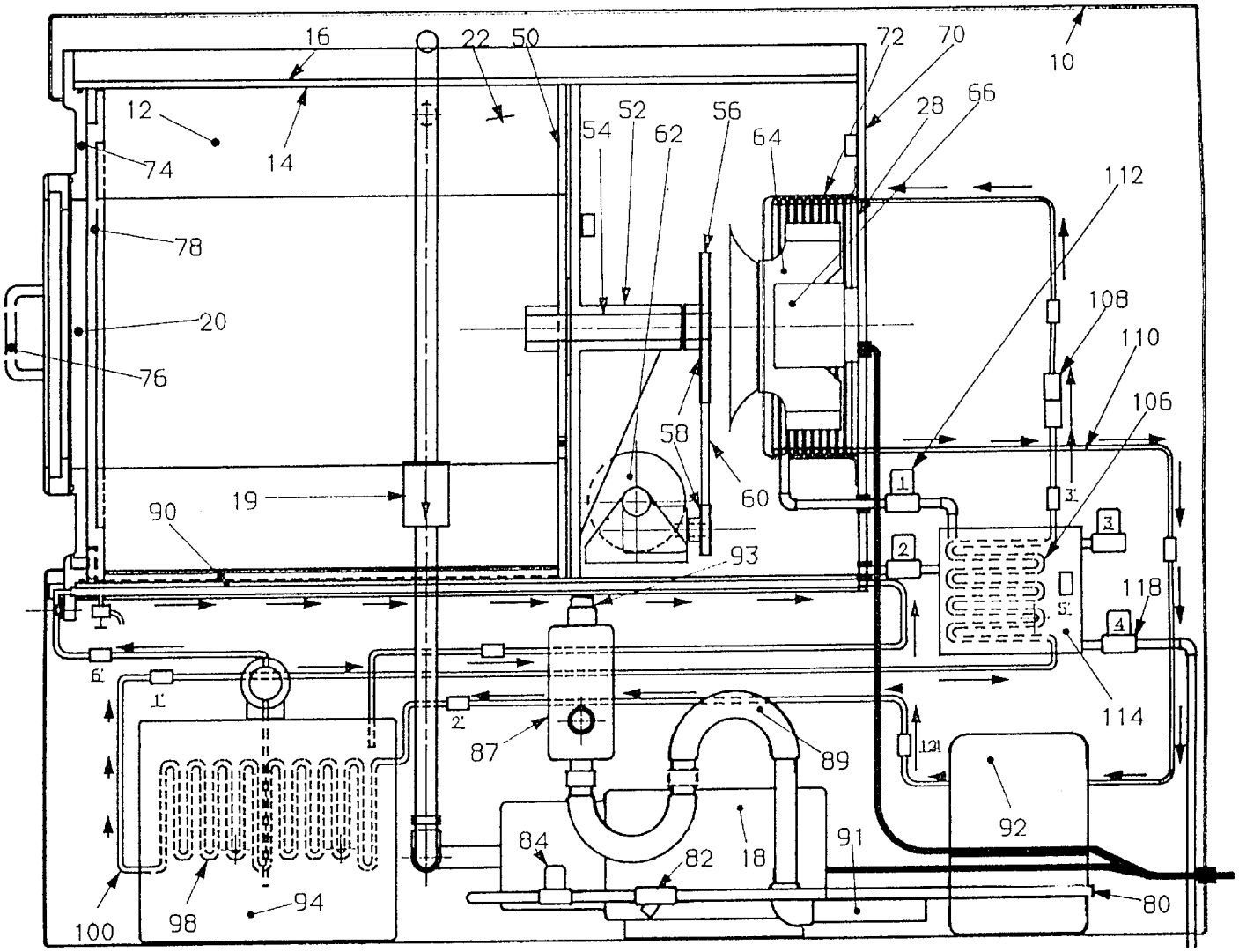
FIG. 2 is a cross sectional side view of the instant invention.
Figure 3:
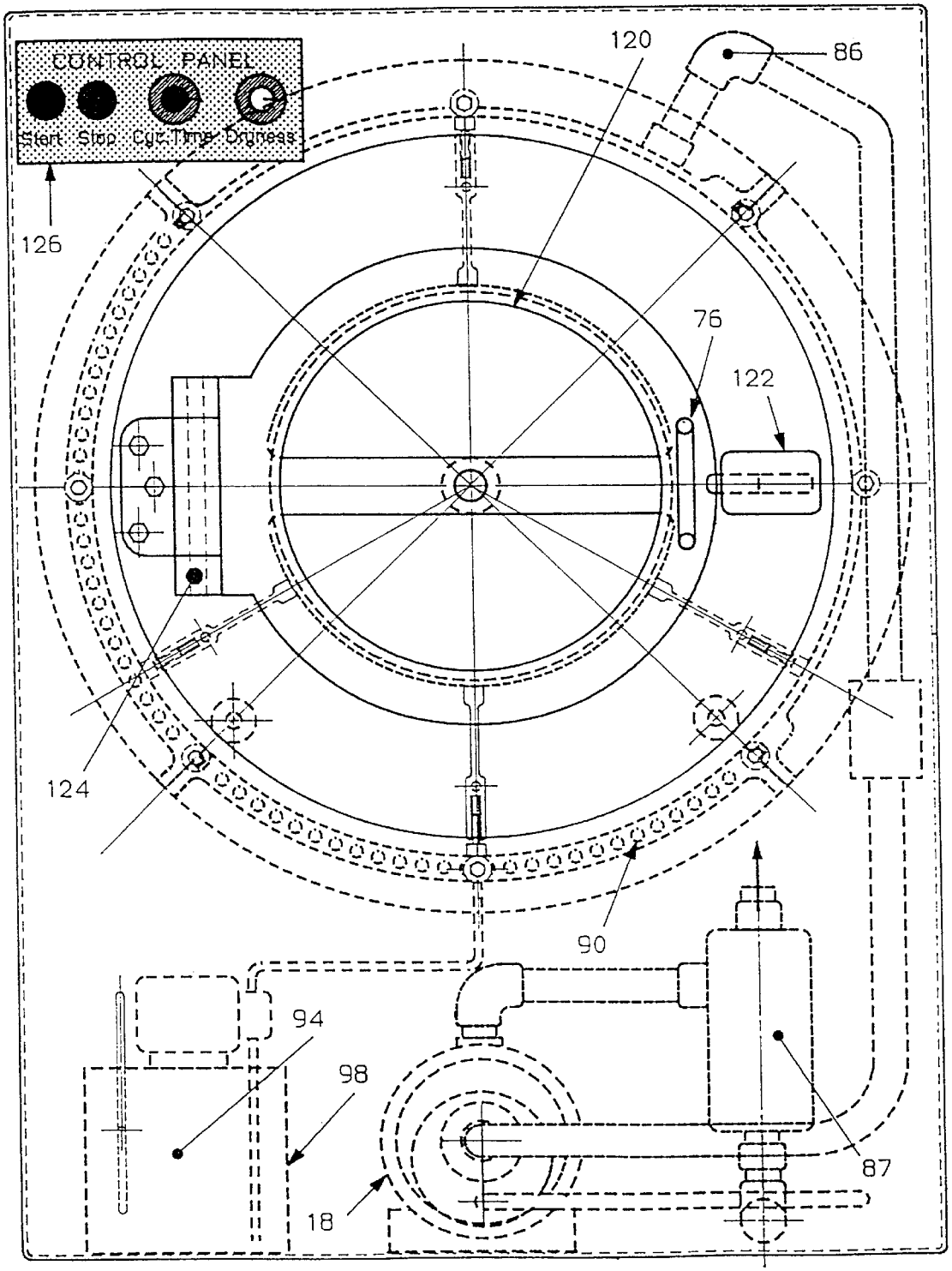
FIG. 3 is a cross sectional end view of FIG. 2.

Referring now to FIGS. 2 and 3, the material dryer device of the instant invention consists of a housing 10 sized to support the operating components of the system including a cylindrically shaped chamber 12 mounted horizontally within the housing 10. The chamber 12 is hermetically sealed defining an interior 14 coated with teflon or the like non-stick coating material and an exterior 16. A rear cage end plate 50 is positioned at the back of the chamber 12 for positioning of clothing placed within the chamber. The chamber includes pusher bars or paddles 22 for movement of the clothing around the chamber. The paddles 22 are coupled to a drive shaft support structure 52 held by drive shaft 54. The drive shaft 54 is rotated by a timing belt and pulley assembly having pulleys 58 coupled together by belt 60. The lower pulley 58 is rotated by drive motor 62. The paddles 22 assure clothing contact with the inner surface 14 of the chamber 12 allowing the clothing to enhance heat transfer through the sidewall of the chamber.

A centrifugal fan 64 allows for circulation of water vapor through the chamber and past condensate coils 28. The fan 64 is driven by a fan motor 66 supported by back plate 70. Alternatively the fan 64 can be driven by the paddle motor 62 by use of an additional pulley or modification of the pulley into a fan shape. The condensate coils are enclosed in a shroud 72 causing direction flow of the circulation air past the coils 28.

The interior 14 of the chamber 12 is accessible through a door 20 hingedly coupled to one end of the housing 10 along a front door end plate 74 and maintaining a pressure seal to the chamber 12 when closed. The door includes a handle 76 for ease of access. The front of the chamber includes a front cage end plate 78 which is operatively associated with the inner surface of the door 20 for securely positioning the clothes within the chamber.

The interior of the chamber is fluidly coupled to a vacuum pump 18 capable of a drawdown vacuum of approximately 28 inches Hg. The vacuum pump is water sealed with a water inlet 80 drawn through strainer 82 and controlled by inlet solenoid 84. The vacuum pump 18 operates initially to withdraw air from the chamber through exhaust check valve 19 and associated piping 86 for maintaining a low pressure environment during the drying cycle. The vacuum pump exhausts air through the air silencer 87 out of outlet 93. The pump includes a trap 89 to further seal as well as prevent back flow of water discharged to the drain 91.

The chamber may be heated by an electric coil or utilize hot water preheater lines 90 provided by the compressor system 92 wherein the compressor 92 operates at a pressure between 250 and 280 psi. The pressurized fluid is directed through the hot water preheating tank 94 by input pipe 96 through a coiled wrap 98 wherein the input temperature to the compressor at exit pipe 100 is between 220° and 250° F. The heated water is transferred by pump 102 from tank 94 through preheater lines 90 which engage at least a portion of the chamber. The pressurized refrigerant from the compressor 92 is then directed through precooling coils 106 and into expansion valve 108 as it is introduced into the condensate coils 28. Low pressure refrigerant 110 is returned to the compressor motor 92. Condensed moisture is collected along the bottom of the condensate shroud 72 and directed through solenoid valve 112 and into water collector tank 114. The solenoid valve 112 is used to maintain a vacuum in the chamber until the condensate is ready to flow into the water collector tank 114. The water collector tank is purged by a dump valve 118 when the drying cycle is complete, should excess water be present in the collection tank during the drying cycle.

As further illustrated in FIG. 3, the door includes a view area 120 and a solenoid operated latch opener 122 which allows access to the chamber only when the vacuum is removed. The door is mounted along hinge 124 providing a pivotal opening. The chamber heating coil 90 is placed around a portion of the chamber and in particular the area that the wet clothes will contact during rotation. Control panel 126 provides operational control of the system.

Figure 4:
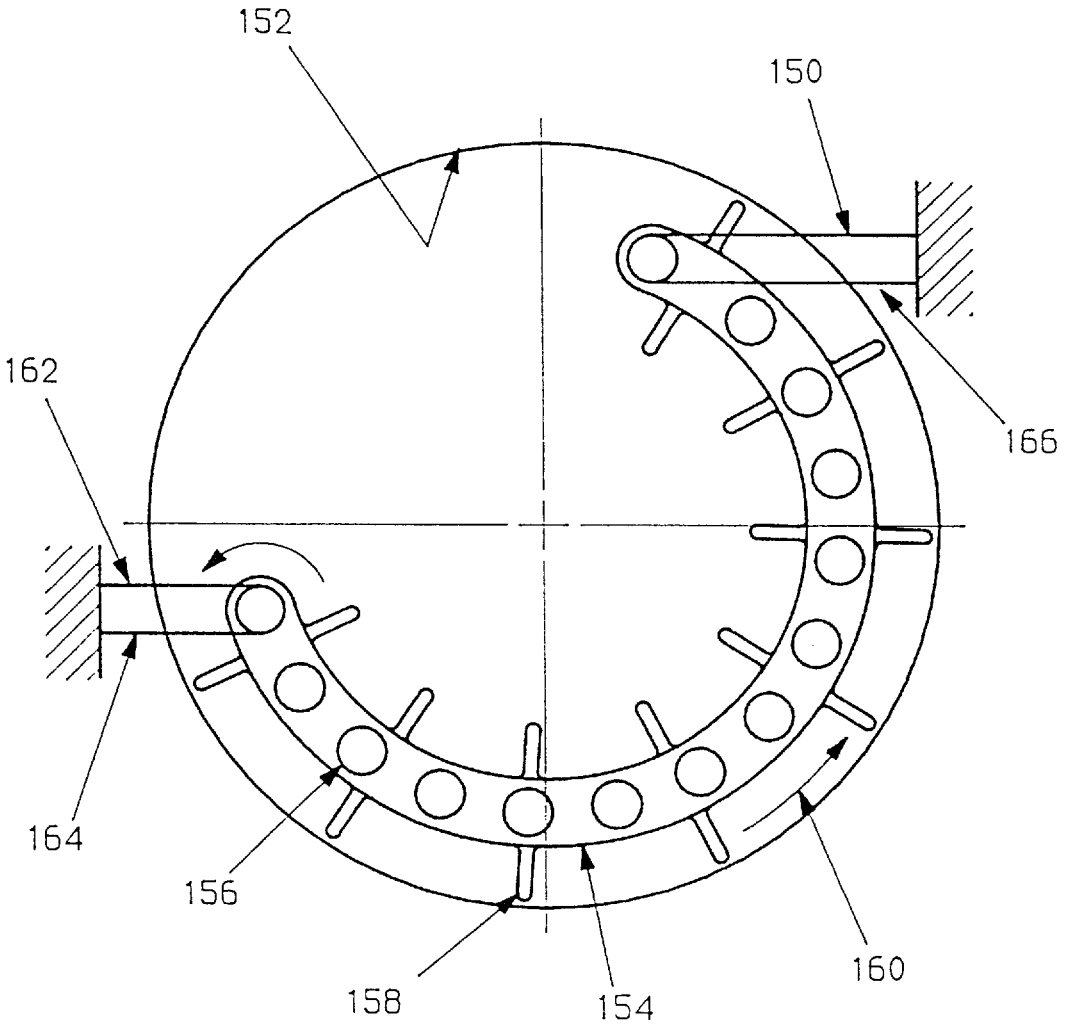
FIG. 4 is a cross sectional pictorial side view of a conveyor belt transport.

FIG. 4 depicts a conveyor belt means 150 depicted along a portion of interior surface 152 of the chamber. In this embodiment, the conveyor belt consists of a continuous flexible belt 154 placed over rollers 156 wherein at least one of the rollers 156 is rotated by an electric motor to cause rotation of the belt. The belt may include paddles 158 to assist is transferring material along a portion of interior surface 152 along directional arrow 160. This embodiment has a particular application for clothing as the belt 154 causes the clothing to maintain a close proximity to the interior surface which, as previously described, allows heat transfer into the clothing to provide heat of vaporization. The entry area 162 may be enlarged to accommodate the type of material circulated wherein paddle 158' provides an enlarged grasp of the material for placement into the entry area 162. The conveyor assembly 150 can be supported by brackets 164 and 166. Bracket 164 may be made adjustable to accommodate various size loads.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A material dryer device comprising:

a housing; a hermetically sealed cylindrically shaped chamber mounted within said housing, said chamber having an interior and an exterior surface;

a pump in fluid communication with said interior for drawing a vacuum in said chamber;

a door hingedly coupled to one end of said chamber, said door allowing a resealable access to said interior for placing wet material along an inner surface of said interior;

means for elevating the temperature of said chamber;

means for rotating the material along said inner surface of said interior;

a condensate coil for condensing moisture contained in the material placed in said interior; and a container for storing condensed moisture.

2. The material dryer device according to claim 1 including a means for circulating water vapor past said condensate coils.

3. The material dryer device according to claim 1 wherein said means for rotating the material is further defined as a conveyor belt means.

4. The material dryer device according to claim 1 wherein said means for rotating the material is further defined as at least one paddle assembly extending substantially along the longitudinal length of said chamber.

5. The material dryer device according to claim 1 including a means for pressurizing and heating fluid directed through said means to elevate chamber temperature, said pressurized and heated fluid drawn through an expansion valve juxtapositioned to said condensate coil.

6. The material dryer device according to claim 5 including a hot water preheating tank.

7. The material dryer device according to claim 1 wherein said means for elevating the temperature of said chamber is defined as a water jacket with heat drawn from a condensate hot water preheating tank.

8. The material dryer device according to claim 1 wherein said means for elevating the temperature of said chamber is defined as a heating means placed along an outer surface of said chamber.

9. The material dryer device according to claim 1 wherein said means for elevating the temperature of said chamber is defined as a coil placed along an outer surface of said chamber through which flows said pressurized fluid.

10. The material dryer device according to claim 5 wherein said fluid is pressurized to about 265 psi.

11. The material dryer device according to claim 1 wherein said pump has a drawdown vacuum of approximately 28 inches Hg.

12. A material dryer device comprising:

a housing; a hermetically sealed cylindrically shaped chamber mounted within said housing, said chamber having an interior and an exterior surface;

a pump in fluid communication with said interior for drawing a vacuum in said chamber;

a door hingedly coupled to one end of said chamber, said door allowing a resealable access to said interior for placing wet material along an inner surface of said interior;

means for elevating the temperature of said chamber;

a conveyor assembly causing placement of said wet material along an interior surface of said chamber;

a condensate coil for condensing moisture contained in said wet material placed in said interior;

means for pressurizing and heating fluid directed through said means to elevate chamber temperature, said pressurized and heated fluid drawn through an expansion valve juxtapositioned to said condensate coil; means for circulating water vapor past said condensate coils; and a container for storing condensed water vapor.

13. The material dryer device according to claim 12 including a hot water preheating tank.

14. The material dryer device according to claim 13 wherein said hot water preheating tank is maintained at a temperature of about 175° F.

15. The material dryer device according to claim 12 wherein said fluid is pressurized to about 265 psi.

16. The material dryer device according to claim 12 wherein said pump has a drawdown vacuum of approximately 28 inches Hg.

17. The material dryer device according to claim 12 including a means controlling the operation of said material dryer according to the moisture contents of clothing placed within the chamber.

* * * * *